US006975341B2

(12) United States Patent
Connor et al.

(10) Patent No.: US 6,975,341 B2
(45) Date of Patent: Dec. 13, 2005

(54) PREVENTING CREASE FORMATION IN DONOR WEB IN DYE TRANSFER PRINTER THAT CAN CAUSE LINE ARTIFACT ON PRINT

(75) Inventors: Eric J. Connor, Rochester, NY (US); Po-Jen Shih, Webster, NY (US); Zhanjun Gao, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/776,746

(22) Filed: Feb. 11, 2004

(65) Prior Publication Data

US 2005/0174421 A1 Aug. 11, 2005

(51) Int. Cl.[7] ..... B41J 25/312
(52) U.S. Cl. ..... 347/198
(58) Field of Search ..... 347/197, 198; 400/120.16, 120.17

(56) References Cited

U.S. PATENT DOCUMENTS 6,400,387 B1 * 6/2002 Kerr ..... 347/198
6,549,224 B2 4/2003 Connor

FOREIGN PATENT DOCUMENTS

JP 62-240564 * 10/1987 ..... B41J 25/28
JP 03-261562 * 11/1991 ..... B41J 25/312

* cited by examiner

*Primary Examiner*—Huan Tran
(74) *Attorney, Agent, or Firm*—Mark G. Bocchetti

(57) ABSTRACT

A thermal printer is adapted to prevent crease formation in a dye transfer area of a dye donor web that can cause line artifacts to be printed on a dye receiver during a dye transfer from the dye transfer area to the dye receiver in a dye transfer printer.

14 Claims, 12 Drawing Sheets

1

PREVENTING CREASE FORMATION IN DONOR WEB IN DYE TRANSFER PRINTER THAT CAN CAUSE LINE ARTIFACT ON PRINT

CROSS-REFERENCE TO RELATED APPLICATIONS

Cross-reference is made to commonly assigned, application Ser. No. 10/391,175, entitled PREVENTING CREASE FORMATION IN DONOR WEB IN DYE TRANSFER PRINTER THAT CAN CAUSE LINE ARTIFACT ON PRINT, and filed Mar. 18, 2003 in the names of Zhanjun J. Gao, John F. Corman and Robert F. Mindler, Po-Jen Shih and Theodore J. Skomsky, and Ser. No. 10/414,568, entitled PREVENTING CREASE FORMATION IN DONOR WEB IN DYE TRANSFER PRINTER THAT CAN CAUSE LINE ARTIFACT ON PRINT, and filed Apr. 16, 2003 in the names of Robert F. Mindler and Theodore J. Skomsky.

Further reference is made to commonly assigned U.S. Pat. No. 6,549,224 B4, issued Apr. 15, 2003. The patent is incorporated in this application.

FIELD OF THE INVENTION

The invention relates generally to dye transfer or thermal printers. More particularly, the invention relates to the problem of creases or wrinkles being formed in the dye transfer areas of a dye donor web during dye transfer printing. Crease formation in a dye transfer area can result in an undesirable line artifact being printed on a dye receiver.

BACKGROUND OF THE INVENTION

A typical multi-color dye donor web that is used in a dye transfer or thermal printer is substantially thin and has a repeating series of three different rectangular-shaped color sections or patches such as a yellow color section, a magenta color section and a cyan color section. In addition, there may be a transparent colorless laminating section immediately after the cyan color section.

Each color section of the dye donor web consists of a dye transfer area which is used for dye transfer printing and a pair of opposite longitudinal edge areas alongside the dye transfer area which often are not used for printing. The dye transfer area may be about 152 mm wide and the two longitudinal edge areas may each be about 5.5 mm wide, so that the total web width is approximately 163 mm.

To make a multi-color image print using a thermal printer, a motorized donor web take-up spool draws a longitudinal portion of the dye donor web off a donor web supply spool in order to successively move an unused single series of yellow, magenta and cyan color sections over a stationary liner array (bead) of selectively heated resistive elements on a thermal print head between the supply and take-up spools. Respective color dyes within the yellow, magenta and cyan color sections are successively heat-transferred line-by-line, via the selectively heated resistive elements, onto a dye receiver medium such as a paper or transparency sheet or roll, to form the color image print. The selectively heated resistive elements often extend across the entire width of a color section, i.e. across the dye transfer area and the two longitudinal edge areas comprising that color section. However, only those resistive elements that contact the dye transfer area are selectively heated. Those resistive elements that contact the two longitudinal edge areas are not heated.

Consequently, the dye transfer occurs from the dye transfer area to the dye receiver medium, but not from the two longitudinal edge areas to the dye receiver medium.

As each color section is drawn over the selectively heated resistive elements, it is subjected to a longitudinal tension particularly by the forward pulling force of the motorized donor web take-up spool. Since the dye transfer area in the color section is heated by the resistive elements, but the two longitudinal edge areas alongside the dye transfer area are not, the dye transfer area is significantly weakened and therefore vulnerable to stretching as compared to the two longitudinal edge areas. Consequently, the longitudinal tension will stretch the dye transfer area relative to the two longitudinal edge areas. This stretching causes the dye transfer area to become thinner than the non-stretched edge areas, which in turn causes some creases or wrinkles to develop in the dye transfer area, most acutely in those regions of the dye transfer area that are close to the non-stretched longitudinal edge areas. The creases or wrinkles occur most acutely in the regions of the dye transfer area that are close to the non-stretched edge areas because of the sharp, i.e. abrupt, transition between the stretched (thinner) transfer area and the non-stretched (thicker) edge areas.

As the dye donor web is pulled by the motorized donor web take-up spool over the selectively heated resistive elements, the creases or wrinkles tend to spread from a trailing (rear) end portion of a used dye transfer area at least to a leading (front) end portion of the next dye transfer area to be used. A known problem that can result is that the creases in the leading (front) end portion of the next dye transfer area to be used will cause undesirable line artifacts to be printed on a leading (front) end portion of the dye receiver medium. The line artifacts printed on the dye receiver medium, although they may be relatively short, are quite visible.

The question presented therefore is how to solve the problem of the creases or wrinkles being created in an unused transfer area so that no line artifacts are printed on the dye receiver medium during the dye transfer.

The Cross-Referenced Applications and Patent

The cross-referenced applications each disclose a thermal printer capable of preventing crease formation in a dye transfer area of a dye donor web that can cause line artifacts to be printed on a dye receiver during the dye transfer from the dye transfer area to the dye receiver. To prevent crease formation, there is provided a crease-preventing platen roller that is movable to hold a dye transfer area and the two longitudinal edge areas alongside the dye transfer area against a print head. The crease-preventing roller has a pair of roller end portions that apply a constant pressure against the two longitudinal edge areas, and a roller main portion between the roller end portions that applies a lesser pressure against the dye transfer area. Since the pressure applied against the two longitudinal edge areas is greater than the pressure applied against the dye transfer area, the two longitudinal edge areas will be stretched the same as the dye transfer area, so that creases will not be formed in the dye transfer area. This is so notwithstanding that the dye transfer area is heated by the print head, but the two longitudinal edge areas are not.

In contrast to the cross-referenced applications, the referenced incorporated (prior art) patent discloses a thermal printer that is adapted to optimize print image quality by preventing undesired pressure variations along the line of contact between the dye donor web and the linear array of selectively heated resistive elements in the thermal print head (the patent does not discuss the problem of crease formation). To optimize print image quality, there is provided a plurality of pressure applying rods that bear down on the thermal print head to urge the selected heated resistive elements into pressure contact with the dye donor web. The amount of pressure applied by each rod and the location of each rod along the print head is individually adjusted in response to sensed changes in different operating parameters that negatively affect print image quality, such as print head temperature when printing dark vs. light image portions, and thickness and/or stiffness of the dye donor web.

SUMMARY OF THE INVENTION

According to the invention, there is provided a novel thermal printer capable of preventing crease formation in each dye transfer area of a dye donor web that can cause line artifacts to be printed on a dye receiver during the dye transfer from the dye transfer area to the dye receiver. The thermal printer comprises:

- a thermal print head in pressure contact with the dye transfer area and two opposite edge areas alongside the dye transfer area, and adapted to heat the dye transfer area sufficiently to cause a dye transfer from the dye transfer area to a dye receiver, but not heating the two edge areas sufficiently to allow a dye transfer from the two edge areas to the dye receiver, so that the dye transfer area is vulnerable to being stretched relative to the two edge areas to possibly form creases in the dye transfer area;
- a sensor and control device for determining variations in at least one operating parameter at said print head that can cause stretching of the dye transfer area relative to the two edge areas, during pressure contact of the print head with the dye transfer area and the two edge areas; and
- a pressure applying device connected to the sensor and control device to adjust pressure contact of the print head with the dye transfer area and two edge areas in accordance with variations that are determined via the sensor and control device, to prevent the dye transfer area from being stretched relative to the two edge areas, whereby creases will not be formed in the dye transfer area.

DETAILED DESCRIPTION OF THE INVENTION

Dye Donor Web

Figure 1:
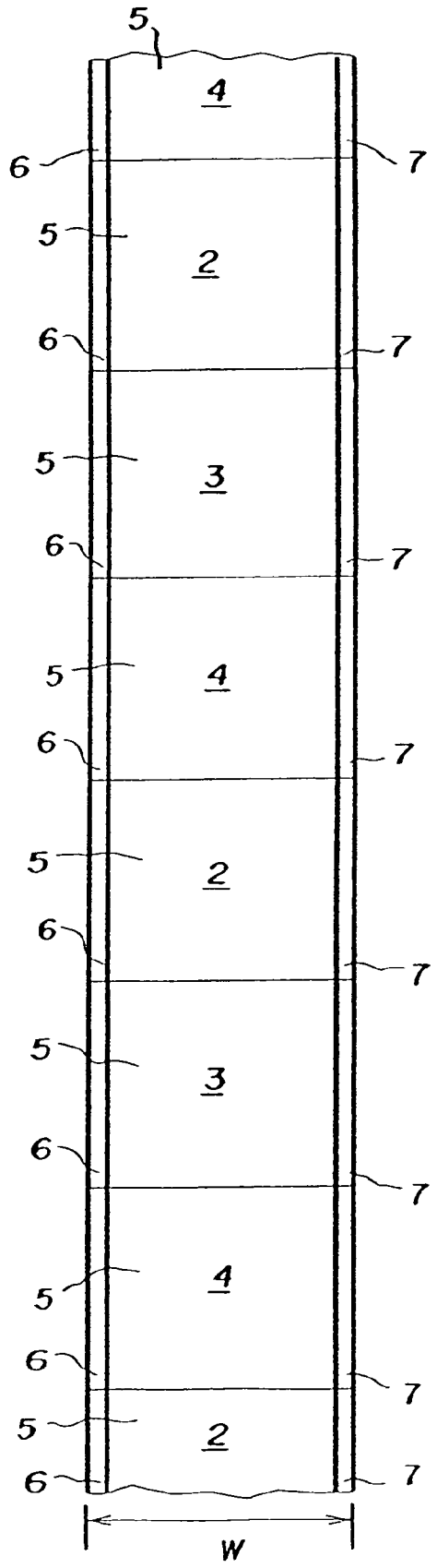
FIG. 1 is plan view of a typical dye donor web including successive dye transfer areas and opposite longitudinal edge areas alongside each one of the dye transfer areas.

FIG. 1 depicts a typical multi-color dye donor web or ink ribbon 1 that is used in a dye transfer or thermal printer. The dye donor web 1 is substantially thin and has a repeating series (only two completely shown) of three different rectangular-shaped color sections or patches such as a yellow color section 2, a magenta color section 3 and a cyan color section 4. In addition, there may be a transparent laminating section (not shown) immediately after the cyan color section 4.

Each yellow, magenta or cyan color section 2, 3 and 4 of the dye donor web 1 consists of a yellow, magenta or cyan dye transfer area 5 which is used for printing and a pair of similar-colored opposite longitudinal edge areas 6 and 7 alongside the dye transfer area which often are not used for printing. Preferably, the dye transfer area 5 is about 152 mm wide and the two edge areas 6 and 7 are each about 5.5 mm wide, so that the total web width W is approximately 163 mm.

Dye Transfer or Thermal Printer

FIGS. 2–6 depict operation of a dye transfer or thermal printer 10 using the dye donor web 1 shown in FIG. 1 to effect successive yellow, magenta and cyan dye transfers onto a known dye receiver sheet 12 such as paper or a transparency.

Initialization

Figure 2:
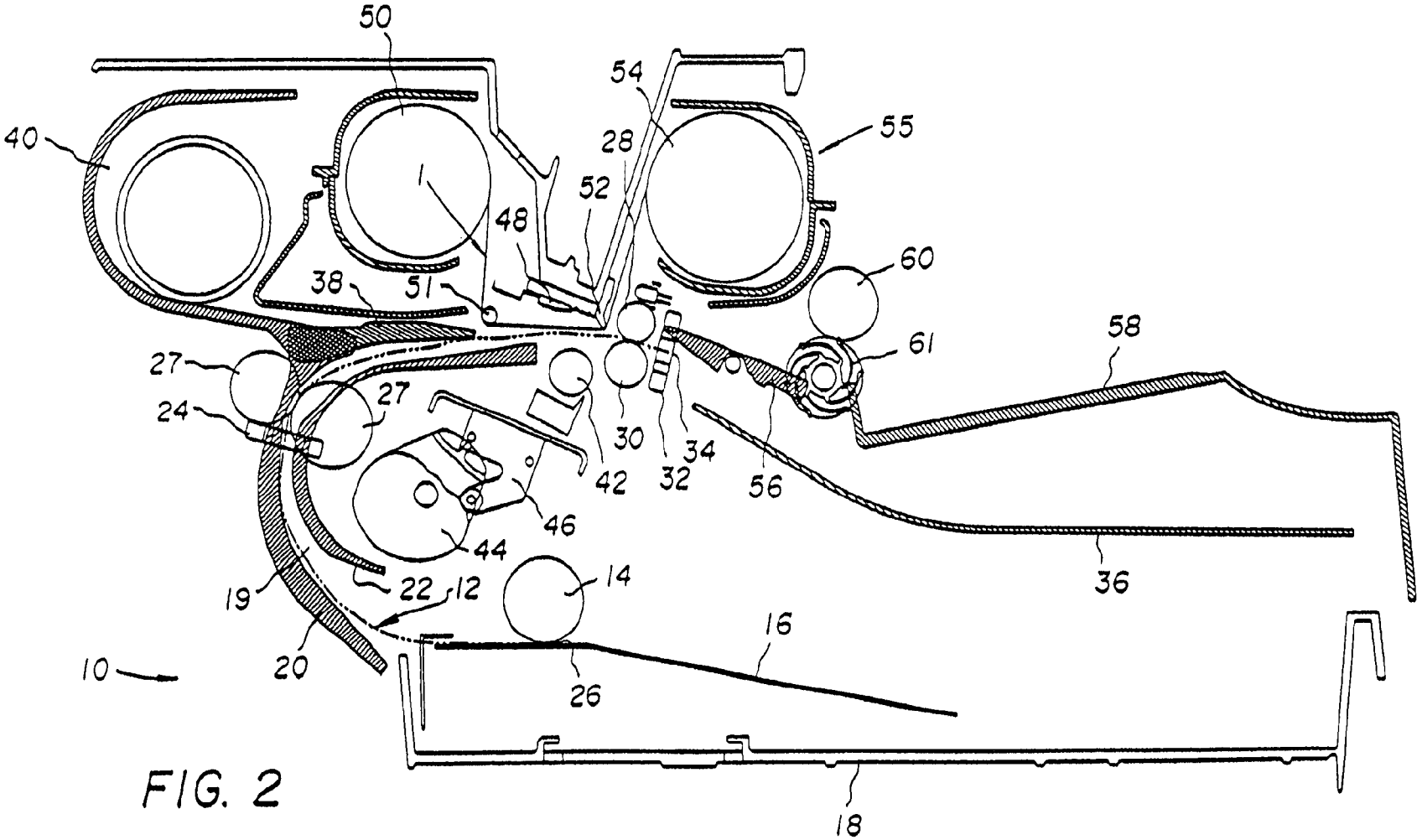
FIG. 2 is an elevation view, partly in section, of a dye transfer or thermal printer, showing a beginning or initialization cycle during a printer operation.

Beginning with FIG. 2, the dye receiver sheet 12 is initially advanced forward via motorized coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing (rear) edge 26 of the dye receiver sheet 12, it activates at least one of pair of motorized parallel-axis urge rollers 27, 27 in the channel 19. The activated rollers 27, 27 then advance the dye receiver sheet 12 forward (to the right in FIG. 2) through the nip of a motorized capstan roller 28 and a pinch roller 30, positioned beyond the channel 19, and to a leading (front) edge sensor 32.

Figure 3:
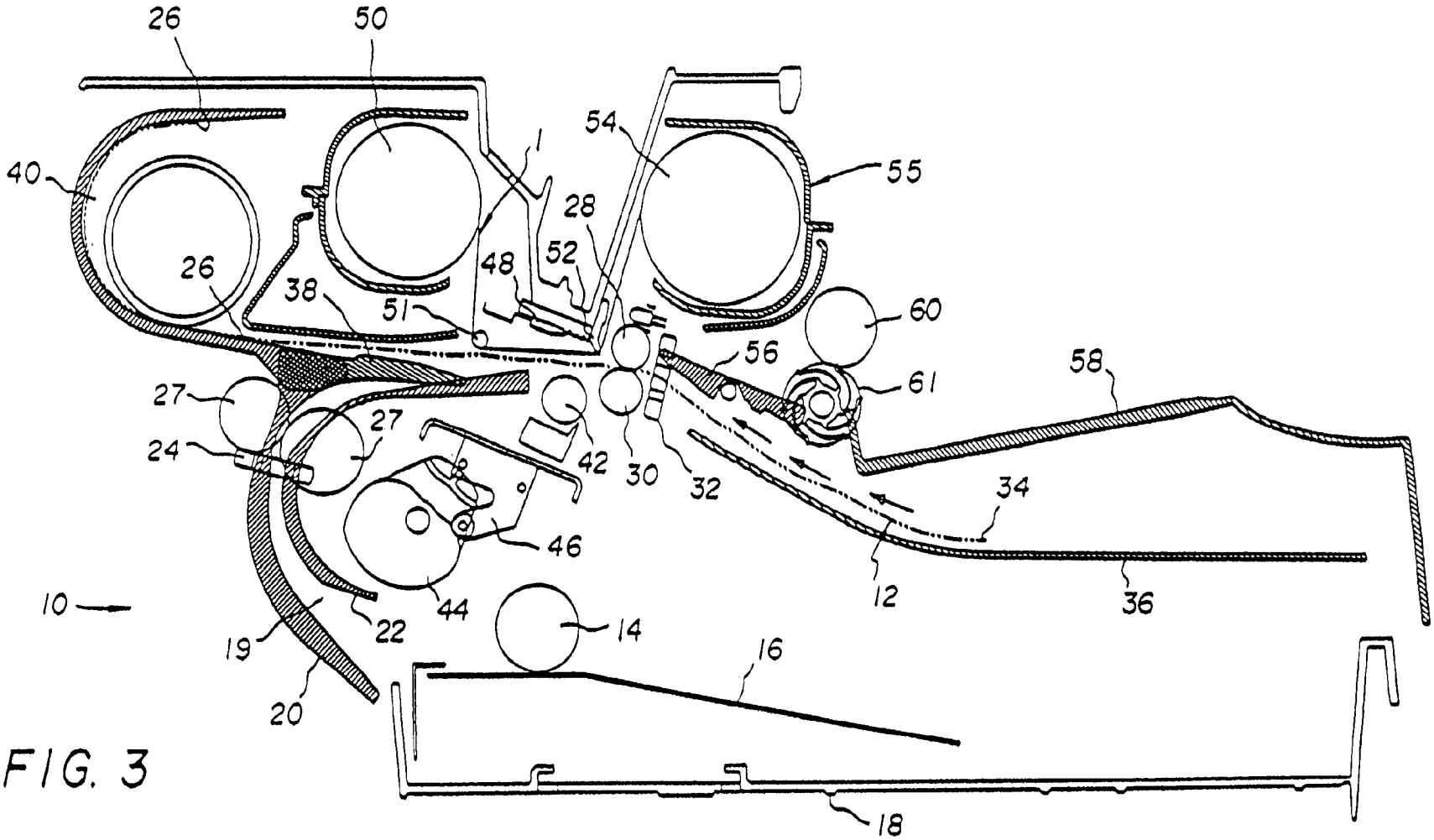
FIGS. 3 and 4 are elevation views, partly in section, of the dye transfer printer, showing successive dye transfer cycles during the printer operation.

In FIG. 3, the leading edge sensor 32 has sensed a leading (front) edge 34 of the dye receiver sheet 12 and activated the motorized capstan roller 28 to cause that roller and the pinch roller 30 to advance the dye receiver sheet forward partially onto an intermediate tray 36. The dye receiver sheet 12 is advanced forward onto the intermediate tray 36 so that the trailing (rear) edge 26 of the dye receiver sheet can be moved beyond a hinged exit door 38 that is a longitudinal extension of the curved guide 20. Then, as illustrated, the hinged exit door 38 closes and the capstan and pinch rollers 28 and 30 are reversed to advance the dye receiver sheet 12 rearward, i.e. rear edge 26 first, partially into a rewind chamber 40.

Successive Yellow Magenta and Cyan Dye Transfers

To make a multi-color image print, respective color dyes in the dye transfer areas 5 of a single series of yellow, magenta and cyan color sections 2, 3 and 4 on the dye donor web 1 must be successively heat-transferred in superimposed relation onto the dye receiver sheet 12. This is shown beginning in FIG. 4.

Figure 4:
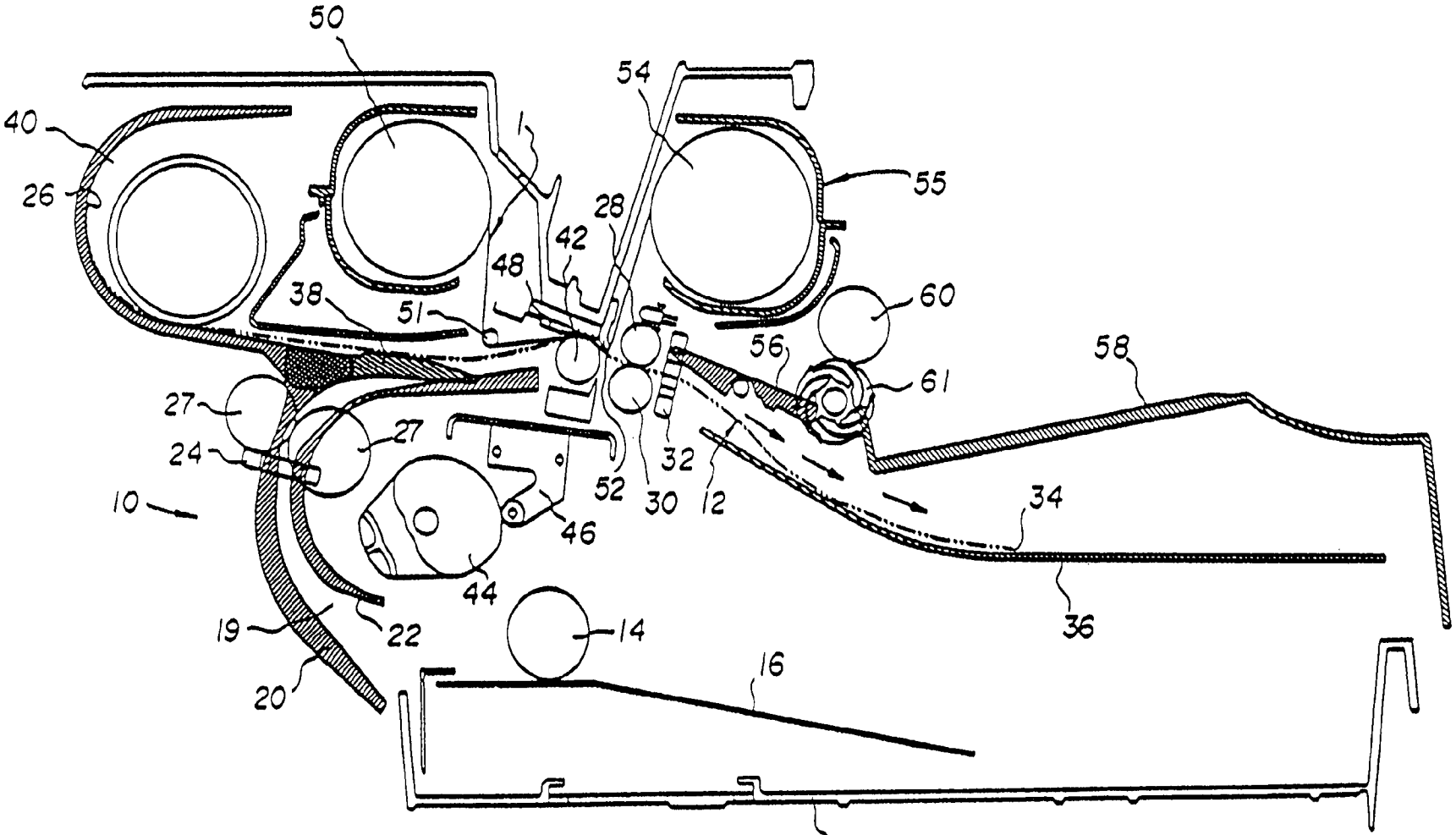
Figure 5:
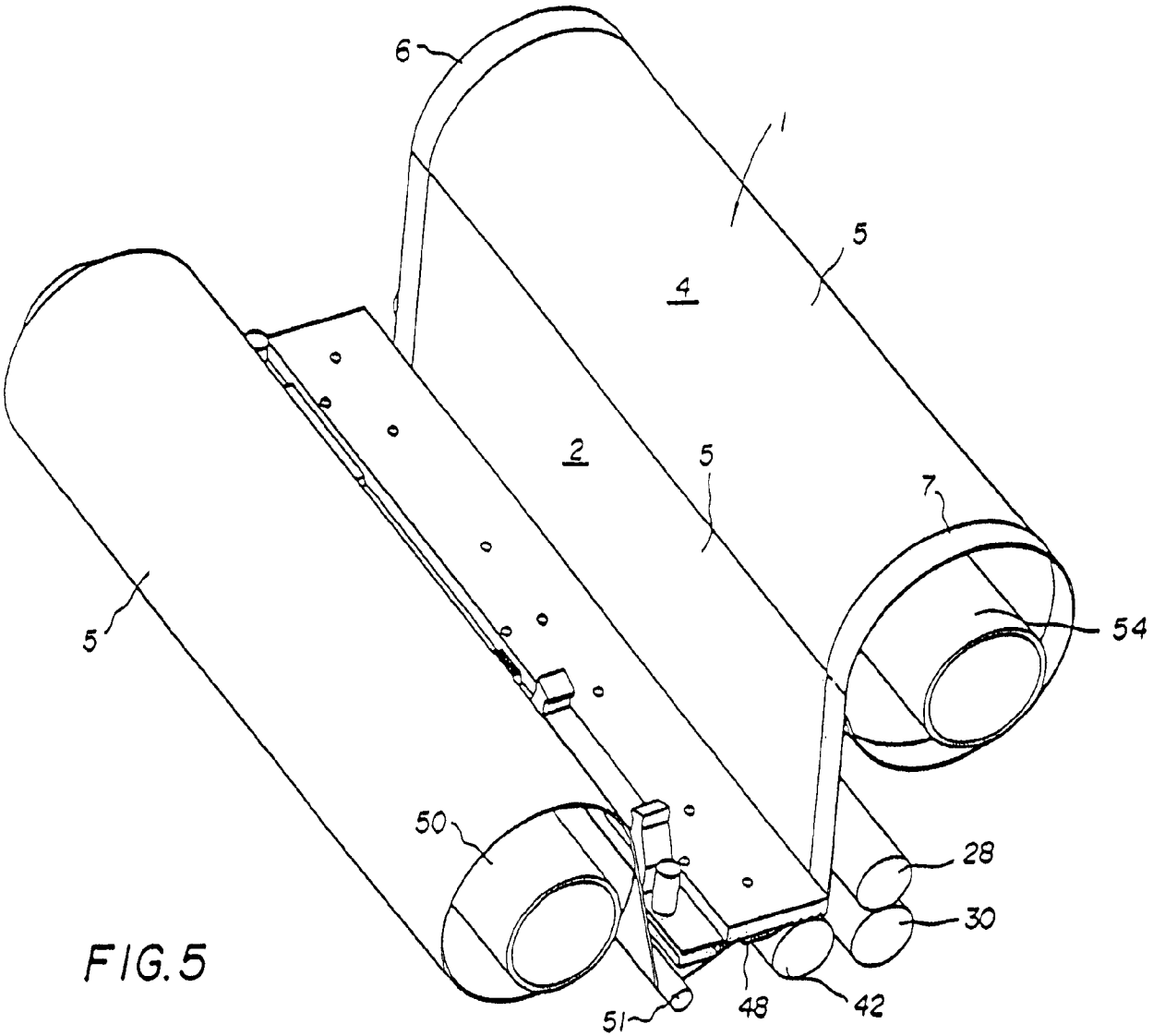
FIG. 5 is perspective view of a printing or dye transfer station in the dye transfer printer.

In FIG. 4, a platen roller 42 is shifted via a rotated cam 44 and a platen lift 46 to adjacent a thermal print head 48. This causes the dye receiver sheet 12 and an unused (fresh) yellow color section 2 of the dye donor web 1 to be locally held together in a pressured relation between the platen roller 42 and the print head 48. The motorized capstan roller 28 and the pinch roller 30 are reversed to again advance the dye receiver sheet 12 forward to begin to return the receiver sheet to the intermediate tray 36. At the same time, the dye donor web 1 is moved forward from a donor web supply spool 50, over a first stationary donor web guide bar 51, over the print head 48, and over a second stationary donor web guide bar or stripper 52. This is accomplished by a motorized donor web take-up spool 54 that incrementally (progressively) pulls or draws the dye donor web forward. The donor web supply and take-up spools 50 and 54 together with the dye donor web 1 may be provided in a replaceable donor web cartridge 55 that is manually loaded into the printer 10.

Figure 7:
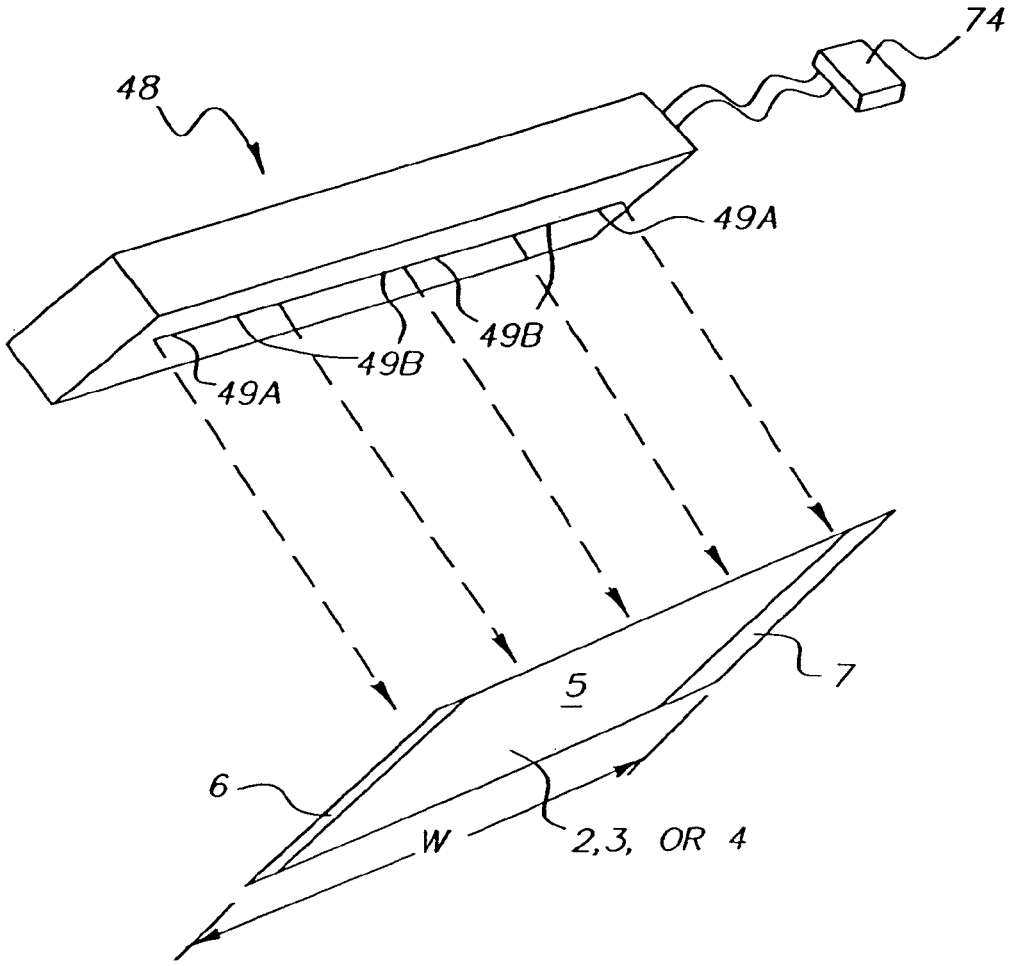
FIG. 7 is a perspective view of a linear array (bead) of selectively heated resistive elements on a thermal print head in the dye transfer printer.

When the yellow color section 2 of the dye donor web 1 is pulled forward over the print head 48 in FIG. 4, the yellow color dye in the dye transfer area 5 of that color section is heat-transferred onto the dye receiver sheet 12. The yellow color dye in the two edge areas 6 and 7 of the yellow color section 2, which are alongside the dye transfer area 5, is not heat-transferred onto the dye receiver sheet 12. In this connection, the print head 48 has a linear array (bead) of selectively heated, closely spaced, resistive elements 49A, 49A, *, 49B, 49B, *, and 49A, 49A, *, on the print head 48 that make pressured print-line-contact across the entire width W of the yellow color section 2, i.e. across its dye transfer area 5 and the two edge areas 6 and 7 alongside the transfer area. As shown in FIG. 7, the resistive elements 49A make pressured contact with the edge areas 6 and 7 and the resistive elements 49B make similar contact with the dye transfer area 5. However, only the resistive elements 49B are selectively heated sufficiently to cause the yellow dye transfer from the dye transfer area 5 to the dye receiver sheet 12. The yellow dye transfer is done one line at a time, i.e. row-by-row, widthwise across the dye transfer area 5. The resistive elements 49A are not heated (or only slightly heated) so that there is no yellow dye transfer from the edge areas 6 and 7 to the dye receiver sheet 12**.

A known heat activating control 74, preferably including a suitably programmed microcomputer using known programming techniques, is connected individually to the resistive elements 49A, 49A, *, 49B, 49B, *, 49A, 49A, *, to selectively heat those resistive elements 49B that make pressured print-line-contact with the dye transfer area 5, and preferably not heat (or only slightly heat) those resistive elements 49A that make pressured contact with the two edge areas 6 and 7 alongside the dye transfer area. See FIG. 7**.

As the yellow color section 2 of the dye donor web 1 is used for dye transfer line-by-line, it is pulled forward from the print head 48 and over the second stationary donor web guide bar or stripper 52 in FIG. 4. Then, once the yellow dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet 12 rearward, i.e. trailing (rear) edge 26 first, partially into the rewind chamber 40. See FIG. 3.

Then, the dye transfer onto the dye receiver sheet 12 is repeated line-by-line in FIG. 4, but this time using an unused (fresh) magenta color section 3 of the dye donor web 1 to heat-transfer the magenta color dye from the dye transfer area 5 of that color section onto the dye receiver sheet. The magenta dye transfer is superimposed on the yellow dye transfer on the dye receiver sheet 12.

Once the magenta dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing (rear) edge 26 first, partially into the rewind chamber 40. See FIG. 3.

Then, the dye transfer onto the dye receiver sheet 12 is repeated line-by-line in FIG. 4, but this time using an unused (fresh) cyan color section 4 of the dye donor web 1 to heat-transfer the cyan color dye from the dye transfer area of that color section onto the dye receiver sheet. The cyan dye transfer is superimposed on the magenta and yellow dye transfers on the dye receiver sheet 12.

Once the cyan dye transfer onto the dye receiver sheet 12 is completed, the platen roller 42 is shifted via the rotated cam 44 and the platen lift 46 from adjacent the print head 48 to separate the platen roller from the print head, and the motorized capstan roller 28 and the pinch roller 30 are reversed to advance the dye receiver sheet rearward, i.e. trailing (rear) edge 26 first, partially into the rewind chamber 40. See FIG. 3.

Final

Figure 6:
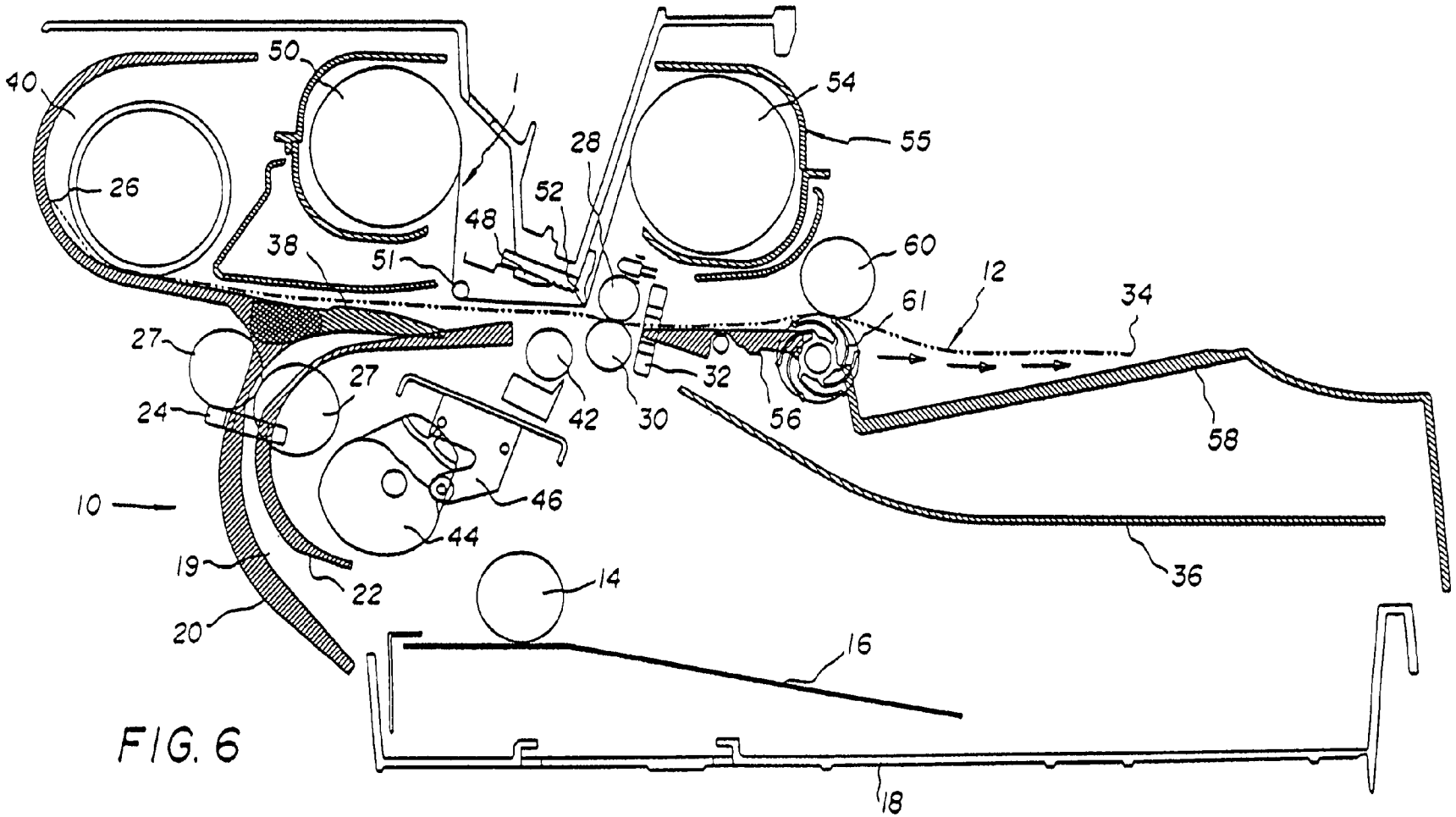
FIG. 6 is an elevation view, partly in section, of the dye transfer printer, showing a final cycle during the printer operation.

Finally, as shown in FIG. 6, the platen roller 42 remains separated from the print head 48 and the motorized capstan roller 28 and the pinch roller 30 are reversed to advance the dye receiver sheet 12 forward. However, in this instance a diverter 56 is pivoted to divert the dye receiver sheet 12 to an exit tray 58 instead of returning the receiver sheet to the intermediate tray 36 as in FIG. 4. A pair of parallel axis exit rollers 60 and 61 aid in advancing the receiver sheet 12 into the exit tray 58.

Prior Art Problem

Figure 8:
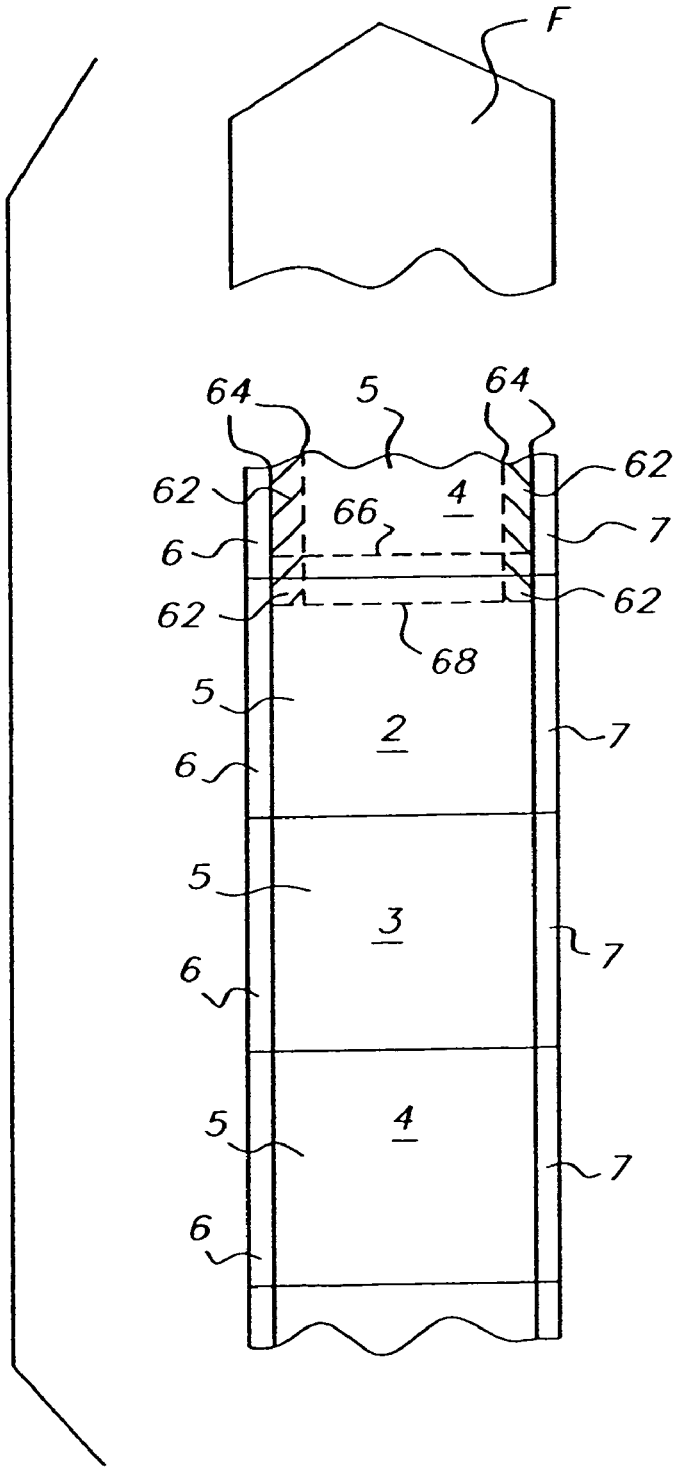
FIG. 8 (PRIOR ART)
FIG. 8 (PRIOR ART) is a plan view of a portion of the dye donor web, showing creases or wrinkles spreading rearward from a trailing (rear) end portion of a used dye transfer area into a leading (front) end portion of an unused dye transfer area in the next (fresh) color section to be used, as in the prior art.

Typically in prior art dye transfer, as each yellow, magenta and cyan color section 2, 3 and 4, including its dye transfer area 5 and the two edge areas 6 and 7 alongside the transfer area, is pulled or drawn forward over the linear array (bead) of selectively heated resistive elements 49A, 49A, *, 49B, 49B, *, 49A, 49A, *, the color section is subjected to a longitudinal tension imposed substantially by a forward pulling force F of the motorized donor web take-up spool 54. See FIG. 8. Moreover, since the dye transfer area 5 is heated by the resistive elements 49B, but the two edge areas 6 and 7 alongside the dye transfer area are not heated by the resistive elements 49A, the dye transfer area is significantly weakened in relation to the two edge areas and therefore becomes more susceptible or vulnerable to being stretched than the two edge areas. See FIG. 7. Consequently, the longitudinal tension imposed by the forward pulling force F of the motorized take-up spool 54 can longitudinally stretch the dye transfer area 5 relative to the two edge areas 6 and 7. As is known, this stretching causes the dye transfer area 5 to become thinner than the non-stretched edge areas 6 and 7, which in turn causes slanted creases or wrinkles 62 to develop in the dye transfer area, most acutely in those regions 64 of the dye transfer area that are close to the two edge areas. See FIG. 8. The slanted creases or wrinkles 62 occur most acutely in the regions 64 of the dye transfer area 5 that are close to the two edge areas 6 and 7** because of the sharp, i.e. abrupt, transition between the weakened transfer area and the stronger edge areas.

Figure 9:
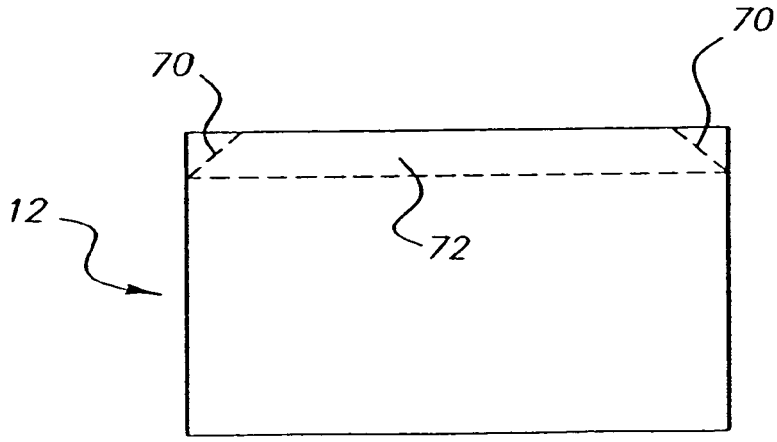
FIG. 9 (PRIOR ART)
FIG. 9 (PRIOR ART) is a plan view of a dye receiver sheet, showing line artifacts printed on a leading (front) edge portion of the dye receiver sheet, as in the prior art.

As the dye donor web 1 is pulled by the motorized donor web take-up spool 54 over the linear array (bead) of selectively heated resistive elements 49A, 49A, *, 49B, 49B, *, 49A, 49A *, the slanted creases or wrinkles 62 tend to spread rearward from a trailing (rear) end portion 66 of a used dye transfer area 5 at least to a leading (front) end portion 68 of the next dye transfer area to be used. See FIG. 8. A problem that can result is that the slanted creases or wrinkles 62 in the leading or front end portion 68 of the next dye transfer area 5 to be used will cause undesirable line artifacts 70 to be printed on a leading (front) end portion 72 of the dye receiver sheet 12, when the dye transfer occurs at the creases in the leading end portion of the next transfer area to be used. See FIG. 9. The line artifacts 70 printed on the dye receiver sheet 12**, although they may be relatively short, are quite visible.

The question presented therefore is how to solve the problem of the slanted creases or wrinkles 62 being created in an unused transfer area 5 so that no line artifacts 70 are printed on the dye receiver sheet 12 during the dye transfer.

Solution

As previously mentioned, before each yellow, magenta or cyan dye transfer from a dye transfer area 5 to the dye receiver sheet 12, the platen roller 42 is shifted via the rotated cam 44 and the platen lift 46 to adjacent the print head 48. This causes both the dye receiver sheet 12 and an unused yellow, magenta or cyan color section 2, 3 or 4 (comprising a dye transfer area 5 and two edge areas 6 and 7) of the donor web 1 to be intimately held together between the platen roller 42 and the print head 48. The platen roller 42 shown in FIGS. 2–6 is an ordinary roller and, as such, it is substantially ineffective to prevent the slanted creases 62 from forming in the dye transfer area 5, including in the regions 64 of the dye transfer area that are close to the two edge areas 6 and 7, during the dye transfer. See FIG. 8.

According to a preferred embodiment of the invention, shown in FIGS. 10–13, there has been devised a pressure applying device 76 that acts, during the dye transfer from the dye transfer area 5 to the dye receiver sheet 12, to bear down on the thermal print head 48 at determined locations in order to prevent the slanted creases 62 from forming in the dye transfer area. This prevention of crease formation includes in the regions 64 of the dye transfer area 5 that are close to the two edge areas 6 and 7 (see FIG. 8). Generally, speaking, the pressure applying device 76, when required, urges the print head 48 to apply greater pressure against the two edge areas 6 and 7 than against the dye transfer area 5. As a result, the friction between the two edge areas 6 and 7 and the print head 48 is made greater than the friction between the dye transfer area 5 and the print head, so that the two edge areas will be stretched by the pulling force F (see FIG. 8) the same as the dye transfer area 5 in order to prevent crease formation in the dye transfer area.

Figure 10:
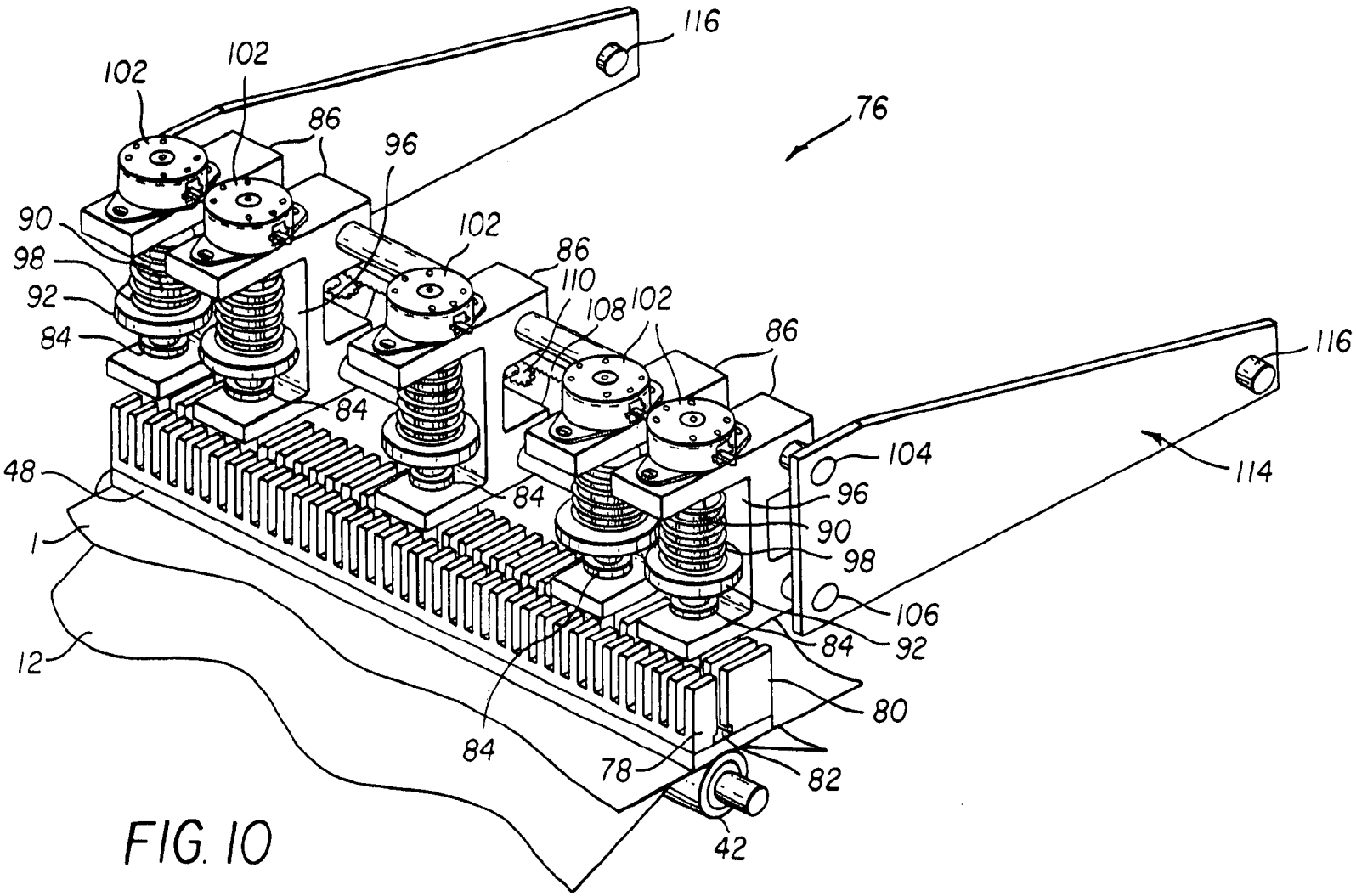
FIG. 10 is a perspective view of a pressure applying device for the thermal print head in the dye transfer printer, according to a preferred embodiment of the invention.
Figure 11:
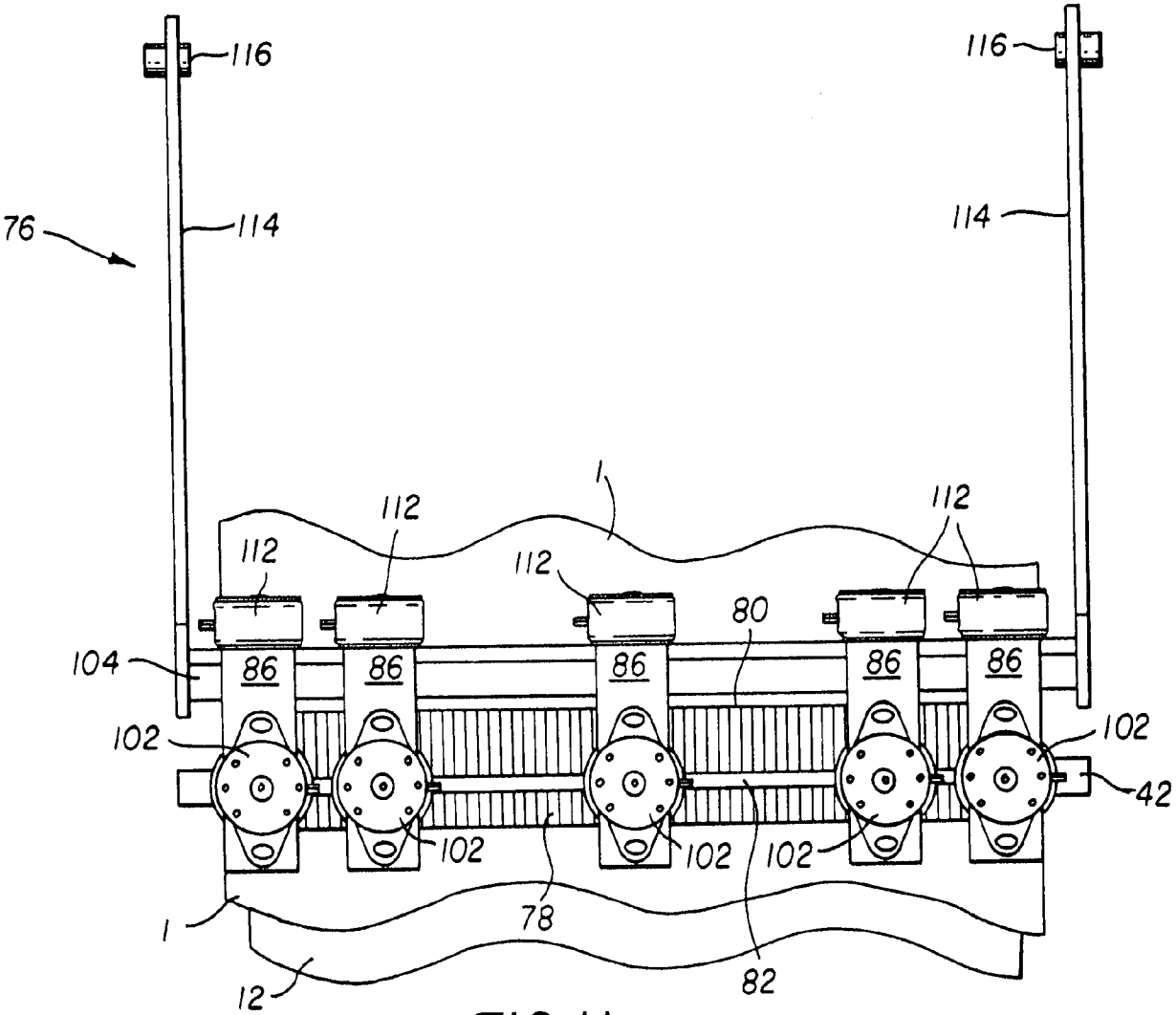
FIG. 11 is top view of the pressure applying device.
Figure 12:
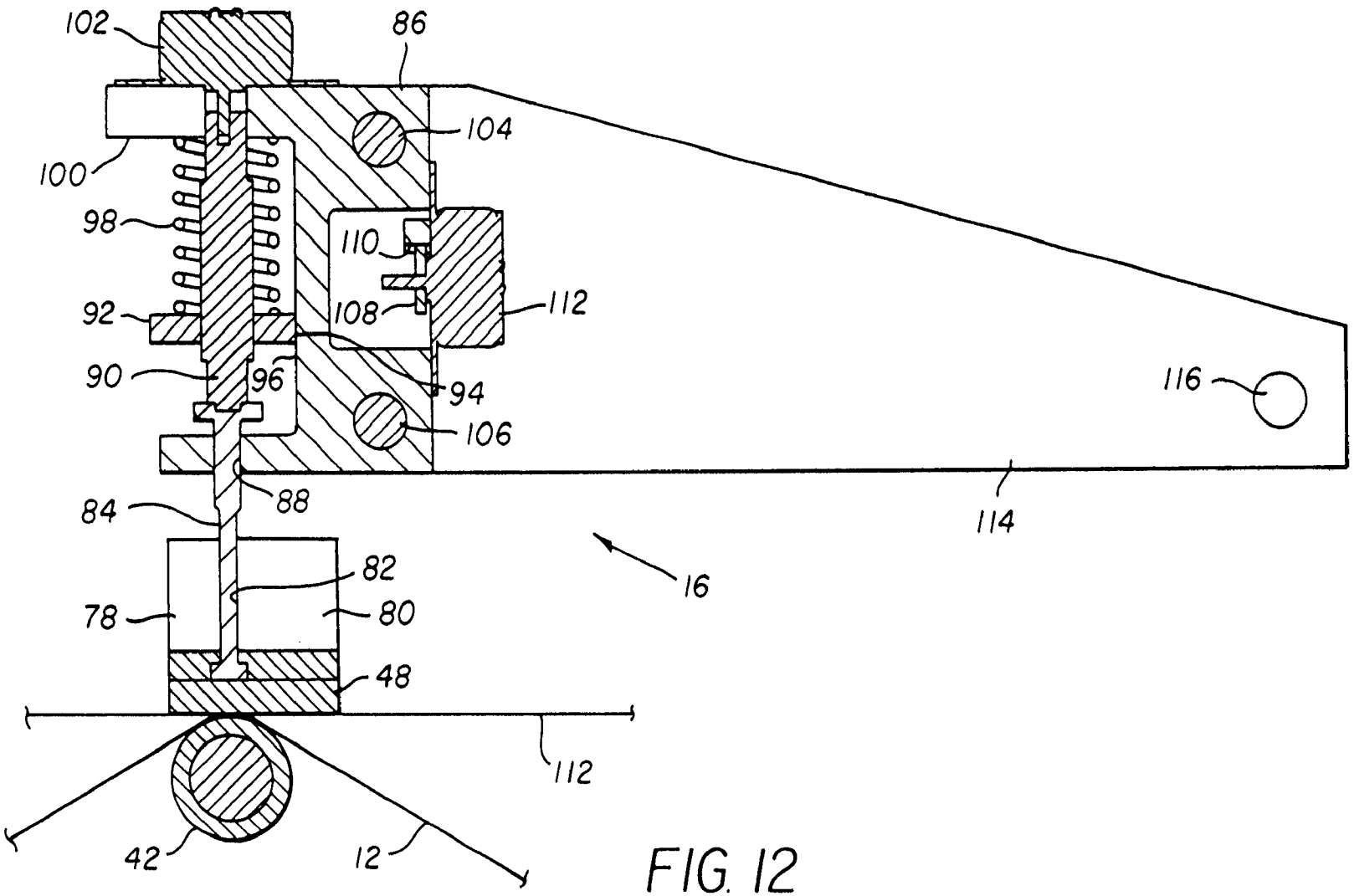
FIG. 12 is a cross-section view of the pressure applying device.

As shown in FIGS. 10–12, the print head 48 is attached to a pair of parallel top mounts 78 and 80 which serve as heat sinks as indicated in U.S. Pat. No. 6,549,224 B2. A longitudinal space or channel 82 separates the top mounts 78 and 80. The longitudinal space 82 is parallel to and above the linear array (bead) of selectively heated resistive elements 49A, 49A, *, 49B, 49B, *, 49A, 49A *, on the print head 48**.

The pressure applying device 76 includes a plurality of pressure applying rods or members 84 that depend vertically into the longitudinal space 82 between the top mounts 78 and 80 as shown in FIGS. 10 and 12, and bear down at their lower ends on the print head 48. The pressure applying rods 84 bear down at their lower ends on the print head 48 at various spaced locations above the linear array (bead) of selectively heated resistive elements 49A, 49A, *, 49B, 49B, 49A, 49A *. As indicated in U.S. Pat. No. 6,549,224, the pressure applying rods 84 are supported on respective carriages 86 and vertically extend through individual bottom holes 88 in the carriages as shown in FIGS. 10 and 12. Threaded depressing rods 90 are connected at their lower ends in FIG. 12 to the top ends of the pressure applying rods 84 and are thread-coupled with respective threaded nuts 92 on the carriages 86. The nuts 92 are not fixed to the carriages 86, but instead each have one flat side 94 against a flat wall 96 of a carriage 86. This prevents the nuts 92 from rotating, but permits them to move vertically up and down along the depressing rods 90 (in threaded engagement with the depressing rods) in response to rotation of the depressing rods in opposite directions. In FIGS. 10 and 12, helical compression springs 98 have lower and upper ends urged against the nuts 92 and top undersides 100 of the carriages 86. The springs 98 provide a compressive force against the nuts 98 which causes the pressure applying rods 84 to bear down at their lower ends on the print head 48. When the depressing rods 90 are rotated in one direction, the nuts 92 are raised along the depressing rods in FIGS. 10 and 12, so that the springs 98 will increase their respective compression forces against the nuts to, in turn, increase the localized pressures of the pressure applying rods 84 against the print head 48. Conversely, when the depressing rods 90 are rotated in an opposite direction in FIGS. 10 and 12, the nuts 92 are lowered along the depressing rods, so that the springs 98 will decrease their respective compression forces against the nuts to, in turn, decrease the localized pressures of the pressure applying rods 84 against the print head 48. Pressure adjusting motors 102 are mounted on the carriages 86 and are coaxially coupled with the depressing rods 90 to rotate the depressing rods in the opposite directions.

The carriages 86 are individually slidable along a pair of parallel upper and lower support rods 104 and 106 and are separately moved right or left in FIGS. 10 and 11 by the interaction of pinions 108 on the carriages that rotatably engage a fixed rack 110 parallel to the support rods as indicated in U.S. Pat. No. 6,549,224. Location adjusting motors 112 on the carriages 86 are coaxially coupled with the pinions 108 to rotate the pinions in opposite directions in order to independently translate the carriages 86 right and left in FIGS. 10 and 11 along the support rods 104 and 106. Consequently, the location of each pressure applying rod 84 can be changed along the longitudinal space 82 between the top mounts 78 and 80, so that the location at which each pressure applying rod bears down on the print head 48 above the linear array (bead) of selectively heated resistive elements 49A, 49A, *, 49B, 49B, *, 49A, 49A *, as indicated in FIGS. 10–12**, can be changed.

The rack 110 and the parallel support rods 104 and 106 for the carriages 86 are hold fast on a supporting bracket 114. The supporting bracket 114 is pivotable counter-clockwise in FIGS. 10 and 12 about a pivot rod 116 to swing the pressure applying rods 84 down onto the print head 48, and then it can be temporarily locked in place by known means (not shown). In FIGS. 10–12, the supporting bracket 114 is locked in place.

Figure 13:
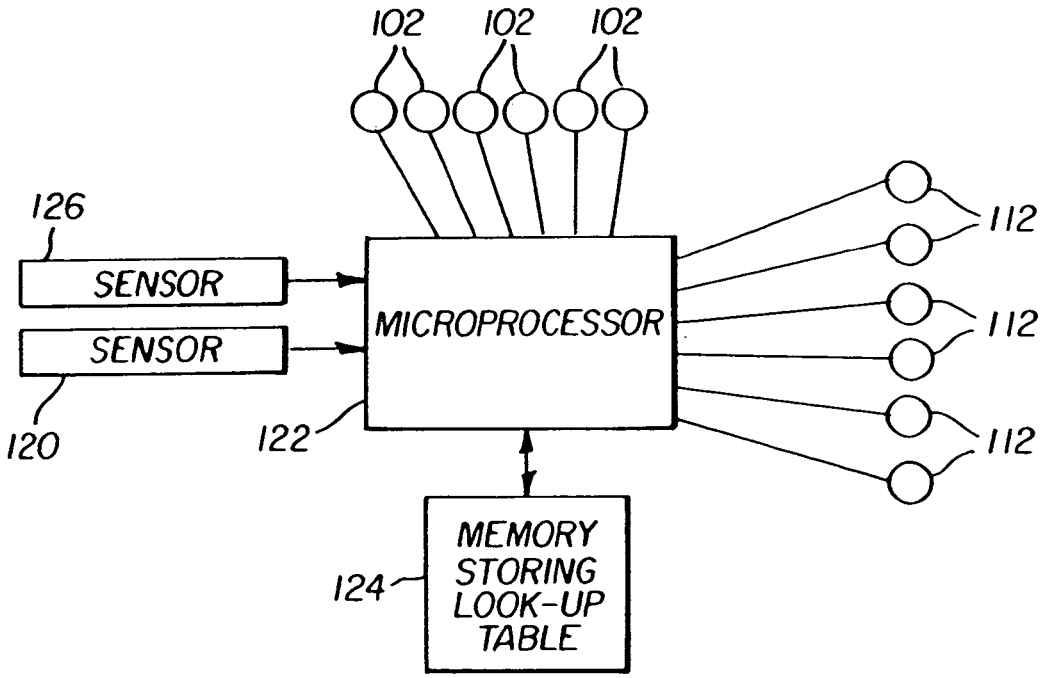
FIG. 13 is a block diagram of a sensor and control device for the pressure applying device.

FIG. 13 shows a sensor and control device 118 for determining variations in at least one operating parameter or condition at the print head 48 that can cause stretching of a dye transfer area 5 relative to the two edge areas 6 and 7 (see FIG. 1), during pressure contact of the print head with the dye transfer area and the two edge areas. A linear array of sensors 120, parallel to the linear array (bead) of selectively heated resistive elements 49A, 49A, *, 49B, 49B, *, 49A, 49A *, sense such an operating parameter or condition and provide representative output signals that are inputted to a microprocessor control 122. The operating parameter or condition that is sensed must be one that affects stretching of the dye transfer area 5 relative to the two edge areas 6 and 7 at the print head 48. For example, the operating parameter or condition may be various temperatures along the width W of the dye transfer area 5 and the two edge areas 6 and 7 adjacent the linear array (bead) of selectively heated resistive elements 49A, 49A, *, 49B, 49B, *, 49A, 49A * (see FIG. 7). In this instance, the sensors 120 sense the temperatures along the width W of the dye transfer area 5 and the two edge areas 6 and 7 and the microprocessor 122 determines whether differences in the temperatures between the two edge areas and the dye transfer area makes the dye transfer area vulnerable to being stretched relative to the two edge areas 6 and 7. The microprocessor 122 employs a memory 124 that stores a look-up table to make the determination. This is done in a known way by comparing the temperatures sensed by the sensors 120 with predetermined threshold values in the look-up table. When it is determined that differences in the temperatures sensed by the sensors 120 makes the dye transfer area 5 vulnerable to being stretched relative to the two edge areas 6 and 7 at the print head 48, the microprocessor 122 energizes the pressure adjusting motors 102 on the carriages 86 to change the respective compressive forces that the springs 98 assert against the nuts 92 to, in turn, change the localized pressures of the pressure applying rods 84 against the print head 48. Also, the microprocessor 122 energizes the location adjusting motors 112 on the carriages 86 to change the locations of the pressure applying rods 84 along the longitudinal space 82 between the top mounts 78 and 80, so that the location at which each pressure applying rod bears down on the print head 48 above the linear array (bead) of selectively heated resistive elements 49A, 49A, *, 49B, 49B, *, 49A, 49A *, is changed. The periods of time that the pressure adjusting motors 102 and the location adjusting motors 112 are energized are controlled by predetermined optimal settings in the look-up table that correspond to the temperatures sensed by the sensors 120**.

The change in pressure loads that the pressure applying rods 84 apply to the print head 48 and the change in locations of the pressure applying rods relative to the print head cause the pressure applying rods to urge the print head 48 to apply greater pressure against the two edge areas 6 and 7 than against the dye transfer area 5. This causes the friction between the two edge areas 6 and 7 and the print head 48 to be made greater than the friction between the dye transfer area 5 and the print head, so that the two edge areas will be stretched by the pulling force F (see FIG. 8) the same as the dye transfer area 5 in order to prevent crease formation in the dye transfer area. Thus, the pressure profile between the print head 48 and the dye transfer area 5 and two edge areas 6 and 7 is changed to prevent the dye transfer area from being stretched relative to the two edge areas in order to prevent crease formation in the dye transfer area.

According to a second example, another operating parameter or condition at the print head 48 that can cause stretching of a dye transfer area 5 relative to the two edge areas 6 and 7 (see FIG. 1), during pressure contact of the print head with the dye transfer area and the two edge areas, may be various temperatures of the selectively heated resistive elements 49A, 49A, *, 49B, 49B, *, 49A, 49A * (see FIG. 7). In this instance, the sensors 120 would sense the temperatures of the selectively heated resistive elements 49A, 49A, *, 49B, 49B, *, 49A, 49A *, and the microcomputer 122 via the look-up table would determine whether the temperatures of the heater elements 49B, 49B, *, that contact the dye transfer area 5 when compared to the temperatures of the heater elements 49A, 49A, *, and 49A, 49A, *, that contact the two edge areas 6 and 7** makes the dye transfer area vulnerable to being stretched relative to the two edge areas.

According to a third example, another operating parameter or condition at the print head 48 that can cause stretching of a dye transfer area 5 relative to the two edge areas 6 and 7 (see FIG. 1), during pressure contact of the print head with the dye transfer area and the two edge areas, may be longitudinal tensions of the dye transfer area and two edge areas (resulting from the pulling force F in FIG. 8) that can cause the dye transfer area to be stretched relative to the two edge areas. In this instance, the sensors 120 act as in the first or second examples and, in addition, other sensors 126 next to the first-mentioned sensors sense longitudinal tensions of the dye transfer area 5 and two edge areas 6 and 7. The microcomputer 122 via the look-up table, besides making the temperature determination as in the first or second example, also determines whether longitudinal tensions of the dye transfer area 5 and two edge areas 6 and 7 can cause the dye transfer area to be stretched relative to the two edge areas.

The invention has been described in detail with particular reference to certain preferred embodiments thereof, but it will be understood that variations and modifications can be effected within the spirit and scope of the invention.

PARTS LIST

1. dye donor web
2. yellow color section
3. magenta color section
4. cyan color section
5. dye transfer area
6. longitudinal edge area
7. longitudinal edge area
W. dye donor web width
10. thermal dye transfer printer
12. dye receiver sheet
14. pick rollers
16. platen
18. tray

19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
48. thermal print head
49A, 49B. linear array (bead) of resistive elements
50. donor web supply spool
51. first stationary (fixed) donor web guide
52. second stationary (fixed) donor web guide
54. donor web take-up spool
55. donor web cartridge
56. diverter
58. exit tray
60. exit roller
61. exit roller
F. forward pulling force
62. slanted creases or wrinkles
64. donor web regions
66. trailing or rear end portion
68. leading or front end portion
70. line artifacts
72. leading or front end portion
74. heat activating control
76. pressure applying device
78. top mount
80. top mount
82. longitudinal space or channel
84. pressure applying rods or members
86. carriages
88. bottom holes
90. threaded depressing rods
92. thread nuts
94. flat sides
96. flat walls
98. springs
100. top undersides
102. pressure adjusting motors
104. upper rods
106. lower rods
108. pinion
110. rack
112. location adjusting motors
114. supporting bracket
116. pivot rod
118. sensor and control device
120. linear array of sensors
122. microprocessor or control
124. memory storing look-up table
126. linear array of sensors

What is claimed is:

1. A thermal printer for use with a dye donor web having successive dye transfer areas and two opposite edge areas alongside each dye transfer area, and capable of preventing crease formation in a dye transfer area that can cause line artifacts to be printed on a dye receiver, said printer comprising:

a thermal print head in pressure contact with the dye transfer area and two opposite edge areas alongside the dye transfer area, and adapted to heat the dye transfer area sufficiently to cause a dye transfer from the dye transfer area to a dye receiver, but not heating the two edge areas sufficiently to allow a dye transfer from the two edge areas to the dye receiver, so that the dye transfer area is vulnerable to being stretched relative to the two edge areas to possibly form creases in the dye transfer area;

a sensor and control device for determining variations in at least one operating parameter at said print head that can cause stretching of the dye transfer area relative to the two edge areas, during pressure contact of said print head with the dye transfer area and the two edge areas; and a pressure applying device connected to said sensor and control device to adjust pressure contact of said print head with the dye transfer area and two edge areas in accordance with variations that are determined via said sensor and control device, to prevent the dye transfer area from being stretched relative to the two edge areas, whereby creases will not be formed in the dye transfer area.

2. A thermal printer as recited in claim 1, wherein said pressure applying device adjusts the magnitude of pressure contact of said print head with the dye transfer area and two edge areas at different locations between said print head and the dye transfer area and two edge areas to create a pressure profile that prevents the dye transfer area from being stretched relative to the two edge areas.

3. A thermal printer as recited in claim 2, wherein said pressure applying device includes a plurality of pressure applying members that each bear down on said print head at separate locations along said print head and are independently adjustable as to the amount of pressure applied and their location in order to apply pressure against the two edge areas that is greater than pressure applied against the dye transfer area.

4. A thermal printer for use with a dye donor web having successive dye transfer areas and two opposite edge areas alongside each dye transfer area, and capable of preventing crease formation in a dye transfer area that can cause line artifacts to be printed on a dye receiver, said printer comprising:

a thermal print head in pressure contact with the dye transfer area and the two edge areas alongside the dye transfer area, and adapted to heat the dye transfer area sufficiently to cause a dye transfer from the dye transfer area to a dye receiver, but not heating the two edge areas sufficiently to allow a dye transfer from the two edge areas to the dye receiver, so that the dye transfer area is vulnerable to being stretched relative to the two edge areas to possibly form creases in the dye transfer area;

a donor web take-up that can longitudinally tension the dye transfer area and two edge areas at said print head sufficiently to stretch the dye transfer area relative to the two edge areas when the dye transfer area is heated to cause a dye transfer to the dye receiver;

a sensor and control device for determining variations in at least one operating parameter at said print head that can cause stretching of the dye transfer area relative to the two edge areas; and a pressure applying device connected to said sensor and control device to adjust pressure contact of said print head with the dye transfer area and two edge areas in accordance with variations that are determined via said sensor and control device, to apply pressure against the two edge areas that is greater than pressure applied against the dye transfer area, so that when said donor web take-up longitudinally tensions the dye transfer area and two edge areas the dye transfer area and two edge areas will be similarly stretched in order to prevent to prevent crease formation in the dye transfer area.

5. A thermal printer as recited in claim 4, wherein said sensor and control device senses temperatures of the dye transfer area and two edge areas at said print head and determines whether differences in temperatures of the dye transfer area and two edge areas makes the dye transfer area vulnerable to being stretched relative to the two edge areas.

6. A thermal printer as recited in claim 4, wherein said print head has a linear array of heater elements that contact the dye transfer area and two edge areas widthwise at said print head, sensors in said sensor and control device sense temperatures of said heater elements, and a controller in said sensor and control device determines whether temperatures of said heater elements that contact the dye transfer area when compared to temperatures of said heater elements that contact the two edge areas makes the dye transfer area vulnerable to being stretched relative to the two edge areas.

7. A thermal printer as recited in claim 6, wherein sensors in said sensor and control device sense longitudinal tensions of the dye transfer area and two edge areas at said linear array of heater elements that contact the dye transfer area and two edge areas widthwise, and said controller determines whether temperatures of said heater elements that contact the dye transfer area and two edge areas and longitudinal tensions of the dye transfer area and two edge areas can cause the dye transfer area to be stretched relative to the two edge areas.

8. A thermal printer as recited in claim 4, wherein sensors in said sensor and control device sense temperatures and longitudinal tensions of the dye transfer area and two edge areas at said print head, and a controller in said sensor and control device determines whether temperatures and longitudinal tensions of the dye transfer area and two edge areas can cause the dye transfer area to be stretched relative to the two edge areas.

9. A method in a thermal printer of preventing crease formation in a dye transfer area of a dye donor web that can cause line artifacts to be printed on a dye receiver during a dye transfer from the dye transfer area to the dye receiver, said method comprising:

providing a thermal print head in pressure contact with the dye transfer area and two opposite edge areas alongside the dye transfer area;

using the print head during pressure contact with the dye transfer area and two edge areas to heat the dye transfer area sufficiently to cause a dye transfer from the dye transfer area to a dye receiver, but not heat the two edge areas sufficiently to allow a dye transfer from the two edge areas to the dye receiver, so that the dye transfer area is vulnerable to being stretched relative to the two edge areas to possibly form creases in the dye transfer area;

determining variations in at least one operating parameter at the print head that can cause stretching of the dye transfer area relative to the two edge areas; and adjusting pressure contact of the print head with the dye transfer area and two edge areas in accordance with variations that have been determined, to prevent the dye transfer area from being stretched relative to the two edge areas, whereby creases will not be formed in the dye transfer area.

10. A method in a thermal printer of preventing crease formation in a dye transfer area of a dye donor web that can cause line artifacts to be printed on a dye receiver during a dye transfer from the dye transfer area to the dye receiver, said method comprising:

using a thermal print head in pressure contact with the dye transfer area and two opposite edge areas alongside the dye transfer area to heat the dye transfer area sufficiently to cause a dye transfer from the dye transfer area to a dye receiver, but not heat the two edge areas sufficiently to allow a dye transfer from the two edge areas to the dye receiver, so that the dye transfer area is vulnerable to being stretched relative to the two edge areas to possibly form creases in the dye transfer area;

longitudinally tensioning the dye transfer area and two edge areas at the print head;

determining variations in at least one operating parameter at the print head that can cause stretching of the dye transfer area relative to the two edge areas, during pressure contact of the print head with the dye transfer area and two edge areas; and adjusting pressure contact of the print head with the dye transfer area and two edge areas in accordance with variations that have been determined, to apply pressure against the two edge areas that is greater than pressure applied against the dye transfer area, so that when the dye transfer area and two edge areas are longitudinally tensioned they will be similarly stretched in order to prevent to prevent crease formation in the dye transfer area.

11. A method as recited in claim 10, wherein variations in at least one operating parameter at the print head are determined by sensing temperatures of the dye transfer area and two edge areas at the print head and determining whether a difference in temperatures of the dye transfer area and two edge areas makes the dye transfer area vulnerable to being stretched relative to the two edge areas.

12. A method as recited in claim 10 wherein the print head has a linear array of heater elements that contact the dye transfer area and two edge areas widthwise at the print head, and variations in at least one operating parameter at the print head are determined by sensing temperatures of the heater elements and determining whether temperatures of the heater elements that contact the dye transfer area when compared to temperatures of the heater elements that contact the two edge areas makes the dye transfer area vulnerable to being stretched relative to the two edge areas.

13. A thermal printer as recited in claim 12, wherein longitudinal tensions of the dye transfer area and two edge areas at the linear array of heater elements that contact the dye transfer area and two edge areas widthwise are sensed, and it is determined whether temperatures of the heater elements that contact the dye transfer area and two edge areas and longitudinal tensions of the dye transfer area and two edge areas can cause the dye transfer area to be stretched relative to the two edge areas.

14. A method as recited in claim 10, wherein variations in at least one operating parameter at the print head are determined by sensing temperatures and longitudinal tensions of the dye transfer area and two edge areas at the print head and determining whether temperatures and longitudinal tensions of the dye transfer area and two edge areas can cause the dye transfer area to be stretched relative to the two edge areas.

* * * * *